US011134748B2

(12) United States Patent
Geis et al.

(10) Patent No.: US 11,134,748 B2
(45) Date of Patent: Oct. 5, 2021

(54) FOOTWEAR WITH A SHELL

(71) Applicant: The North Face Apparel Corp., Wilmington, DE (US)

(72) Inventors: Benoit Geis, Watwiller (FR); Wu Shengching, Taichung (TW)

(73) Assignee: The North Face Apparel Corp., Wilmington, DE (US)

( * ) Notice: Subject to any disclaimer, the term of this patent is extended or adjusted under 35 U.S.C. 154(b) by 77 days.

(21) Appl. No.: 16/653,607

(22) Filed: Oct. 15, 2019

(65) Prior Publication Data

US 2020/0113278 A1 Apr. 16, 2020

Related U.S. Application Data

(60) Provisional application No. 62/861,110, filed on Jun. 13, 2019.

(51) Int. Cl.
*A43B 13/14* (2006.01)
*A43B 13/18* (2006.01)

(52) U.S. Cl.
CPC ..... *A43B 13/18* (2013.01); *A43B 13/145* (2013.01)

(58) Field of Classification Search
CPC ..... A43B 13/12; A43B 13/127; A43B 13/143; A43B 13/145; A43B 13/10
USPC ..... 36/25 R, 30 R
See application file for complete search history.

(56) References Cited

U.S. PATENT DOCUMENTS 5,131,173 A * 7/1992 Anderie ..... A43B 13/14 36/25 R
5,295,314 A * 3/1994 Moumdjian ..... A43B 13/203 36/107
6,321,469 B1 * 11/2001 Cretinon ..... A43B 13/10 36/102
6,497,058 B2 * 12/2002 Dietrich ..... A43B 13/14 36/69
6,973,746 B2 * 12/2005 Auger ..... A43B 1/0072 36/128
7,082,702 B2 * 8/2006 Cretinon ..... A43B 13/026 36/107
7,779,557 B2 * 8/2010 Teteriatnikov ..... A43B 13/145 36/25 R
7,793,437 B2 * 9/2010 Chapman ..... A43B 13/145 36/88
7,877,897 B2 * 2/2011 Teteriatnikov ..... A43B 13/188 36/25 R (Continued)

FOREIGN PATENT DOCUMENTS

EP 3114955 A1 1/2017
FR 2898252 A1 9/2007

(Continued)

*Primary Examiner* — Marie D Bays

(74) *Attorney, Agent, or Firm* — 3 Smith, Gambrell & Russell LLP

(57) ABSTRACT

A shoe may comprise an upper and a comfort sole attached to an outsole, the comfort sole having a radius of curvature at any point of a line from a heel to a toe and interfacing with outsole, wherein the lowest point of comfort sole and outsole, called the center of mass or balance point of the sole or natural balance point of the shoe, when placed on a substantially horizontal reference plane defines a transition zone of the roll of the foot having the highest radius of the comfort sole and the outsole, and in that the center of mass is behind point (B) of the metatarsals; and a rigid shell interposed between the upper and the comfort sole.

20 Claims, 11 Drawing Sheets

(56) References Cited

U.S. PATENT DOCUMENTS

| | | | | |
|---|---|---|---|---|
| 8,079,159 | B1 | 12/2011 | Rosa | |
| 8,776,397 | B2 * | 7/2014 | Borel | A43B 13/16 36/28 |
| 9,289,028 | B1 | 3/2016 | Anderson | |
| 2002/0050078 | A1 * | 5/2002 | Dietrich | A43B 7/24 36/88 |
| 2010/0146819 | A1 * | 6/2010 | Teteriatnikov | A43B 13/145 36/103 |
| 2010/0275471 | A1 * | 11/2010 | Teteriatnikov | A43B 13/145 36/30 R |
| 2010/0307028 | A1 | 12/2010 | Teteriatnikov et al. | |
| 2011/0061264 | A1 * | 3/2011 | Solymosi | A43B 7/142 36/88 |
| 2011/0078923 | A1 * | 4/2011 | Bartholet | A43B 13/187 36/92 |
| 2011/0179669 | A1 | 7/2011 | Hanebrink et al. | |
| 2011/0185593 | A1 * | 8/2011 | Ramos | A43B 13/203 36/103 |
| 2014/0047740 | A1 * | 2/2014 | Tucker | A43B 7/14 36/103 |
| 2014/0250723 | A1 | 9/2014 | Kohatsu | |
| 2017/0095033 | A1 * | 4/2017 | Farina | A43B 13/20 |
| 2017/0245586 | A1 | 8/2017 | Cook et al. | |
| 2019/0343221 | A1 * | 11/2019 | Farr | A43B 23/0235 |
| 2020/0113278 | A1 * | 4/2020 | Geis | A43B 13/187 |

FOREIGN PATENT DOCUMENTS

| | | | |
|---|---|---|---|
| FR | 3087096 | A1 | 4/2020 |
| WO | 2017/045018 | A1 | 3/2017 |
| WO | 2020/081560 | A1 | 4/2020 |
| WO | 2020/081566 | A1 | 4/2020 |

* cited by examiner

FOOTWEAR WITH A SHELL

CROSS-REFERENCE TO RELATED APPLICATION

This application is a nonprovisional of and claims the benefit of U.S. Provisional Application No. 62/861,110, filed Jun. 13, 2019; and claims priority to French Application Number 18/01085, filed Oct. 15, 2018, each of which are hereby incorporated by reference in their entirety.

FIELD OF THE PRESENT DISCLOSURE

The present disclosure relates to a shoe. The present disclosure also relates to a shoe that can be described as high performance.

BACKGROUND

A shoe of is known from document EP 3 114 955. Expanded polyurethane increases the cushioning effect of a sole.

Document FR 2 898 252 also describes a sports shoe, but which is distinguished by the fact that a two-part composite material insert is in engagement with the wear sole and the comfort sole by the heel and in engagement with the comfort sole and the upper by the toe of the shoe. This part of the composite insert increases the elasticity of the tip of the shoe.

In document U.S. Pat. No. 8,079,159, there is described a shoe extending between a toe and a heel and comprising an upper attached to an outsole.

The shoe described in document U.S. Pat. No. 8,079,159 has a modular sole structure.

In document US-2011/0179669 A1, there is described a shoe extending between a toe and a heel and comprising a sole with a radius of curvature.

However, improvements over the prior art are needed.

SUMMARY OF THE PRESENT DISCLOSURE

The present disclosure relates to an improvement to the performance of an outsole of the type mentioned above, and in particular, to propose a soling construction which has a guiding, holding, cushioning, and relaunching effect due to a scalable center of mass. One or more goals may be realized in the shoe claimed in the present disclosure. According to the indications in the introduction, an athletic shoe may be characterized in that the comfort sole has a radius of curvature at any point of a line from the heel to the tip and interfacing with the outsole, and in that the lowest point of the comfort sole and/or outsole, called the center of mass or natural balance point of the shoe, when placed on an appreciably horizontal reference plane, is the transition zone of the roll of the foot having the highest sole radius, and in that the center of mass is located behind the point of the metatarsals.

This construction of the sole may produce beneficial results for use in running, but also, depending on the case, for walking or other uses.

The sole may comprise a shell comprising, consisting essentially of, or consisting of a shell bottom and a shell side.

Due to the mechanical connection of the shell and the comfort sole, the lines of force are stabilized. The rise of the shell sides makes it possible to obtain an additional stability effect through compression of the upper, which is added to the stability effect linked to the gluing of the shell to the comfort sole and also prevents the arch being pushed up the foot in the static and dynamic phases.

Of course, the construction mentioned above is not limited to application in races, and can also be very beneficial in other areas, particularly walking and other uses.

According to the aim sought during the practice of physical activities such as walking, running, etc., the present disclosure enables or prevents excessive deformation of the comfort layer in the impact and flexion phases of the foot.

Therefore, in the example shown, the shoe is particularly intended for racing, especially on rough terrain. It has a fairly low upper and a damping outsole; nevertheless, it is low enough so as not to damage the stability of the foot on uneven ground or on a slope.

According to this previous art, it can be seen that through the heel, the upper is in direct contact with the comfort sole. The purpose of the present disclosure is to modify this art in order to better control the support phase of the sports shoe.

For this purpose, the purpose of the present disclosure shall be a sports shoe conforming to the type indicated in the introduction, characterized in that it may comprise a shell made of plastic or composite material, interposed between the upper and the comfort sole and with which it is engaged by the heel.

The plastic or composite shell gives torsional and bending stiffness to the rod, which prevents the foot from deflecting in the event of an impact between the heel of the shoe and the ground and thus contributes to the stability of the support. By deforming elastically, it also allows a fraction of the energy released by the shock to be released during relaxation by reducing the fraction of energy dissipated by the comfort sole.

Preferably, the plastic or composite shell is interposed and in contact with the upper and the comfort sole up to the tip.

By this arrangement, the shell deforms elastically throughout a stride, from the heel to the toe of the shoe, and provides a stimulating effect of the feet tightened per rod by releasing the stored energy.

Preferably again, the plastic or composite shell is interposed and in engagement with the upper and the comfort sole by through a bottom shell and a side shell. The shell side forms a perimeter around the bottom of the shell to allow the shell on the one hand to stabilize the foot against the ground during a whole stride. The foot tightened by the upper is thus maintained in alignment with the alignment taken by the shoe when the heel hits the ground. On the other hand, the perimeter of the shell side increases the bending and torsional rigidity of the shell. This arrangement is particularly suitable for a road race.

In a mode of execution, the shell flank surrounds a part of the shell bottom corresponding to the heel and is interrupted along a part of said shell bottom corresponding to the tip.

The interruption of the shell flank gives the toe of the shoe flexibility while maintaining stiffness in the heel. This arrangement is more particularly suitable for a race on all roads. In another method of construction, the shell side forms a perimeter of said bottom shell.

The shell flank forms a perimeter around the bottom of the shell to allow the shell to stabilize the foot against the ground for an entire stride. The foot tightened by the upper is thus maintained in alignment with the alignment taken by the shoe when the heel hits the ground. On the other hand, the perimeter of the shell side increases the bending and torsional rigidity of the shell. This arrangement is more particularly suitable for a road race.

Preferably, the side of the shell is provided with indentations.

This arrangement makes it possible to vary the rigidity of the shell, by delimiting rigid sections of the shell side, presenting between them a flexibility provided by the indentations. It is more particularly adapted to mountain running, known as "trail".

Preferably still, the bottom of the shell is openwork. An openwork bottom shell reduces the weight of the shell while maintaining the rigidity provided by the shell side and interfacing with the footing of wear and tear.

The curvature of the comfort sole eliminates the effect of redundancy of the initial impact, felt with a comfort sole without curvature. The transition from the impact to the unfolding of the foot is instantaneous. Combined with the rigidity of the composite shell, the curvature of the comfort sole promotes the energy restitution and thus allows faster and therefore more powerful strides.

The present disclosure relates to a shoe designed to enhance the practice of sports, running, and/or walking. The shoe may comprise an upper over an outsole made according to a stratified profile in several layers fulfilling distinct functions.

BRIEF DESCRIPTION OF THE DRAWINGS

The present disclosure will be better understood using the description and accompanying schematic figures, which illustrate several non-limiting aspects by way of example. Based on the description and figures, those skilled in the art will be able to deduce other advantageous characteristics of the shoe.

Other advantages of the present disclosure will appear in the light of the description of the execution methods illustrated by the drawings.

Figure 1:
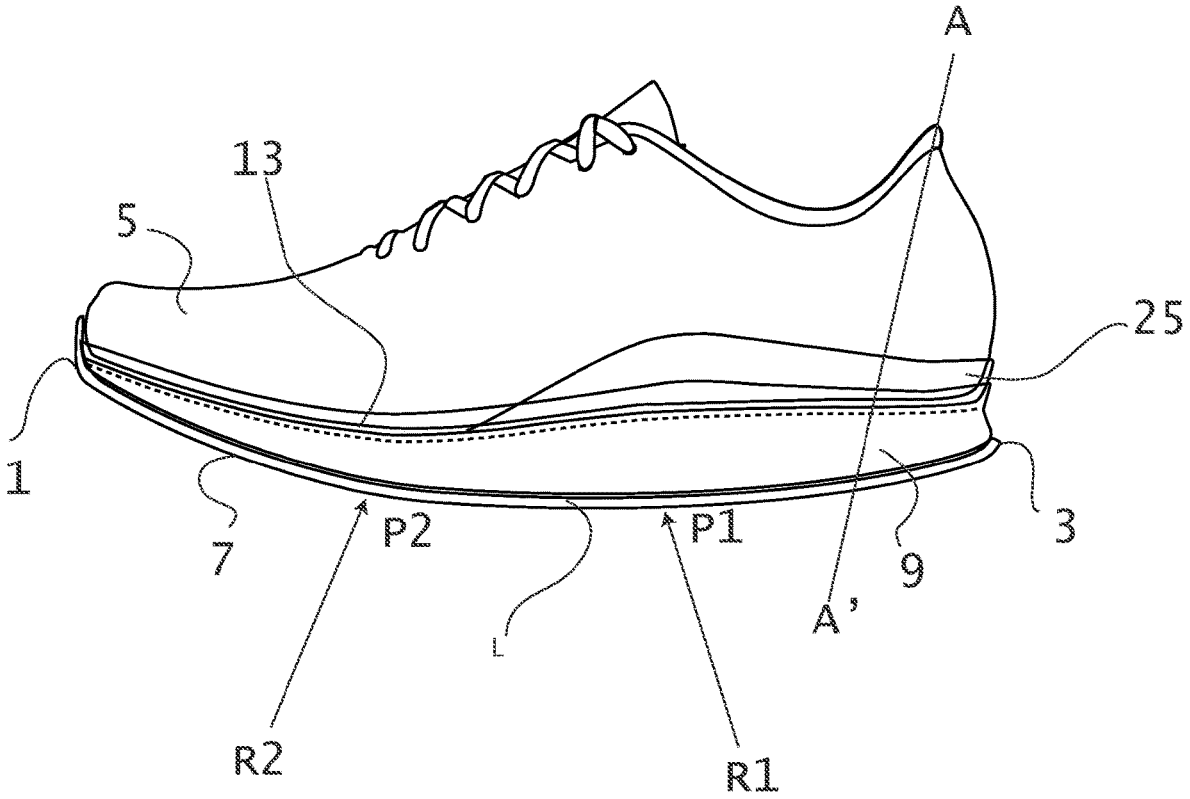
FIG. 1 is a profile view of a first mode of realization of the present disclosure.
Figure 3:
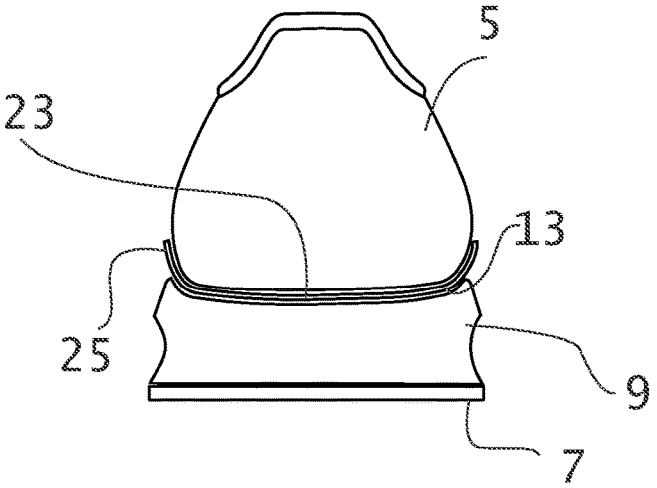
FIG. 3 is a view following the cross-section A-A' of FIG. 1.
Figure 2:
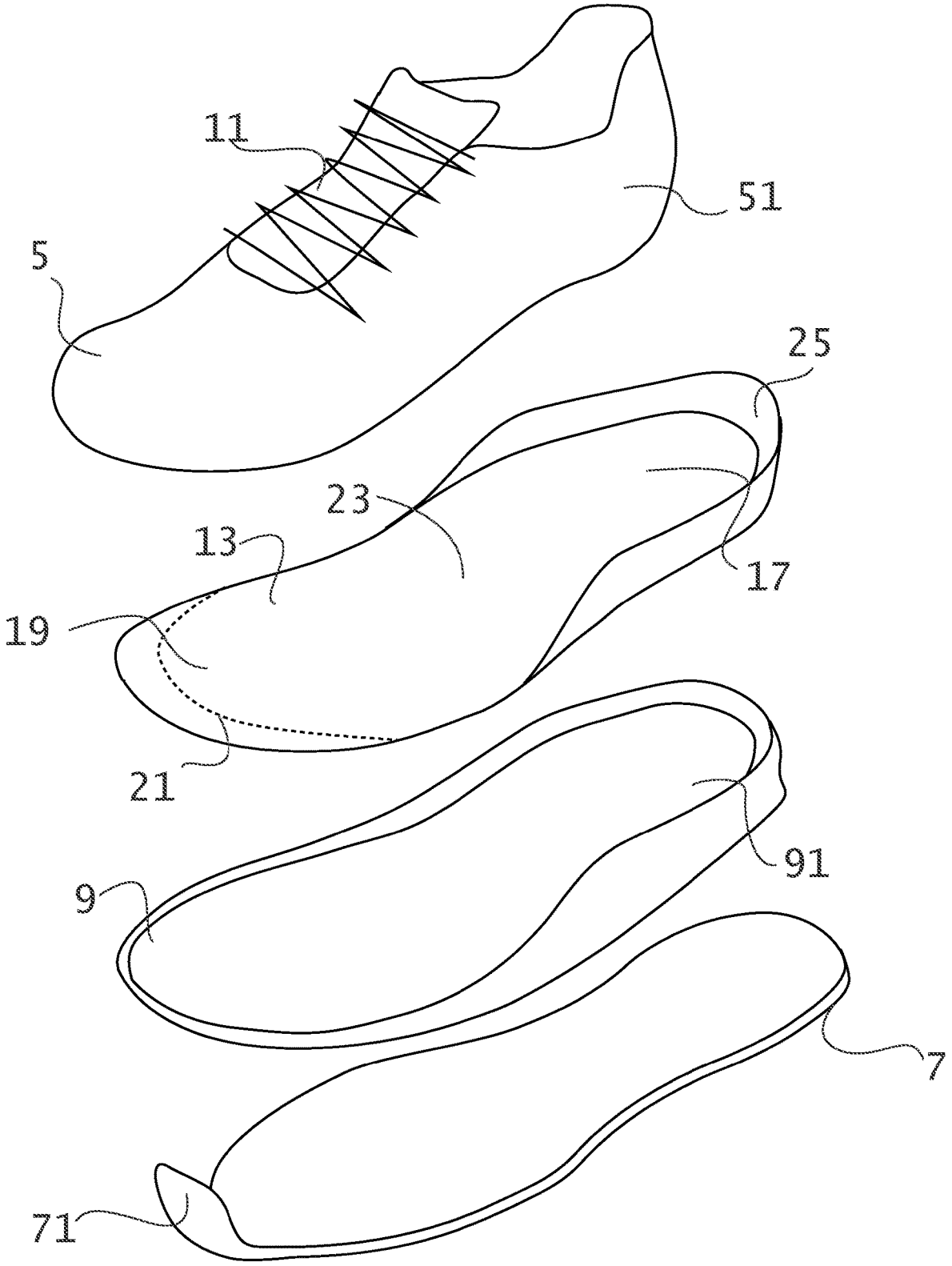
FIG. 2 is an exploded view of FIG. 1.

According to a first mode of realization of the present disclosure, FIGS. 1 to 3, a sports shoe extends between a toe 1 and a heel 3 and includes an upper 5 in engagement with a wear sole 7 via a comfort sole 9.

Figure 11:
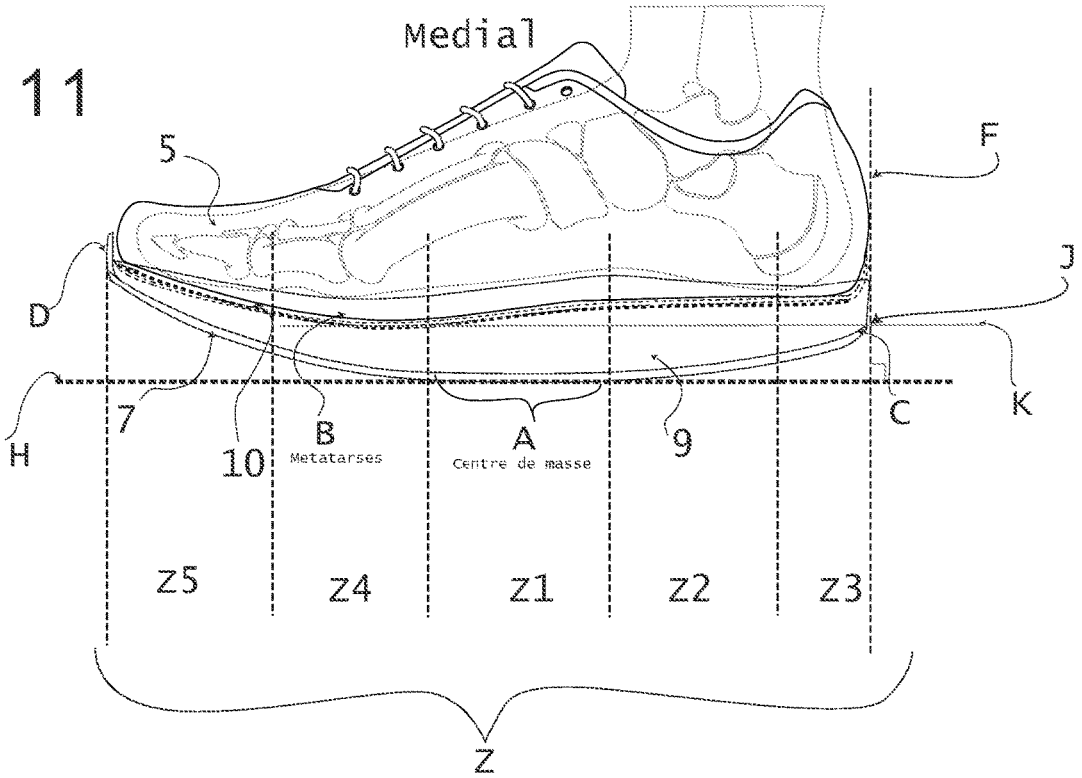

FIG. 11 is a side (medial) view of an aspect of the present disclosure.

Figure 12:
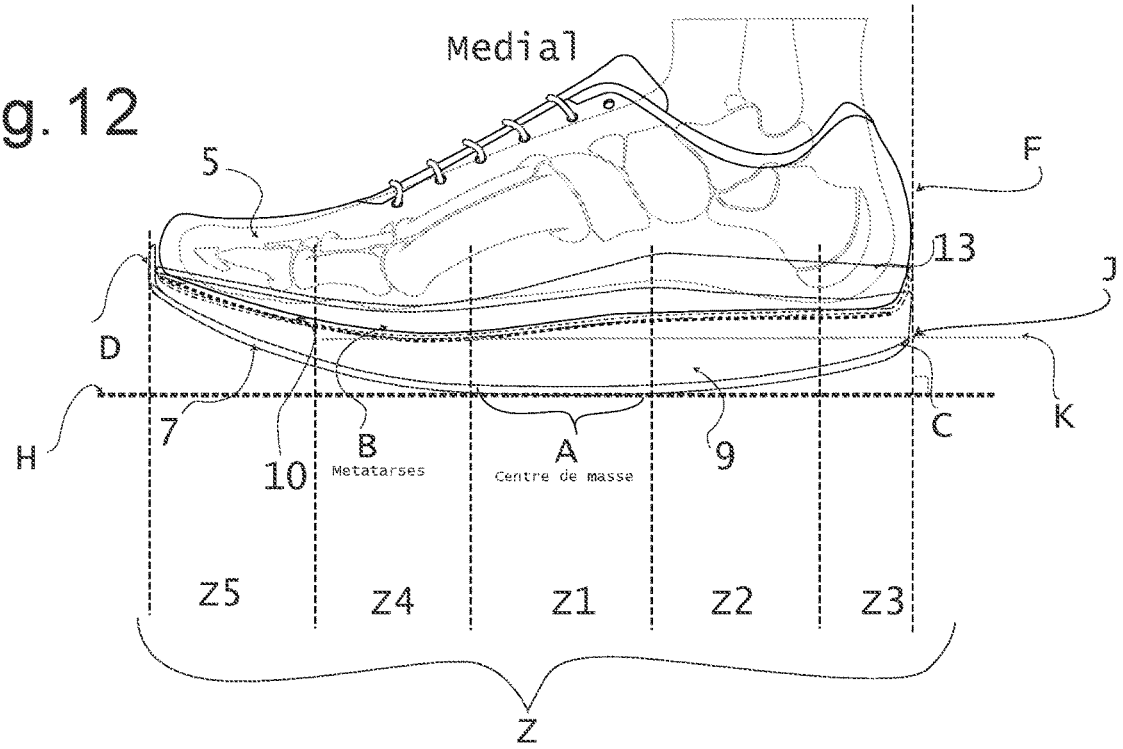

FIG. 12 is a side (medial) view of an aspect of the present disclosure that includes a shell.

Figure 13:
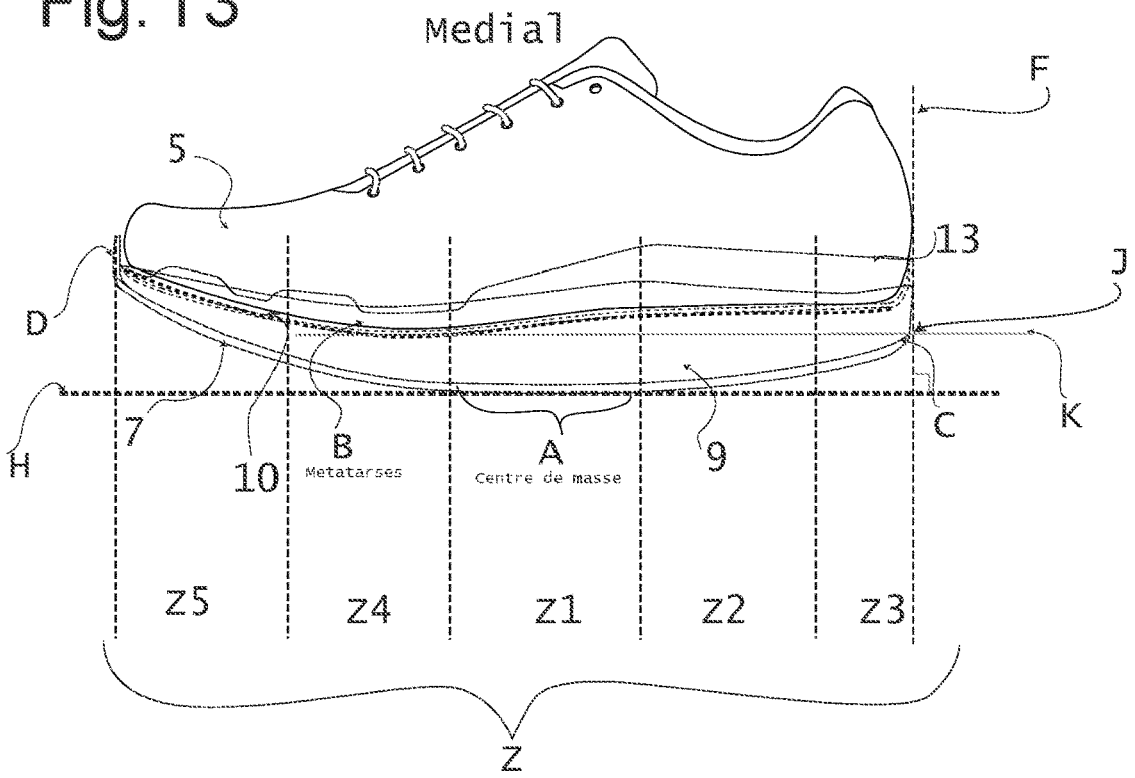

FIG. 13 is a side (medial) view of an aspect of the present disclosure that includes a shell with notches.

Figure 14:
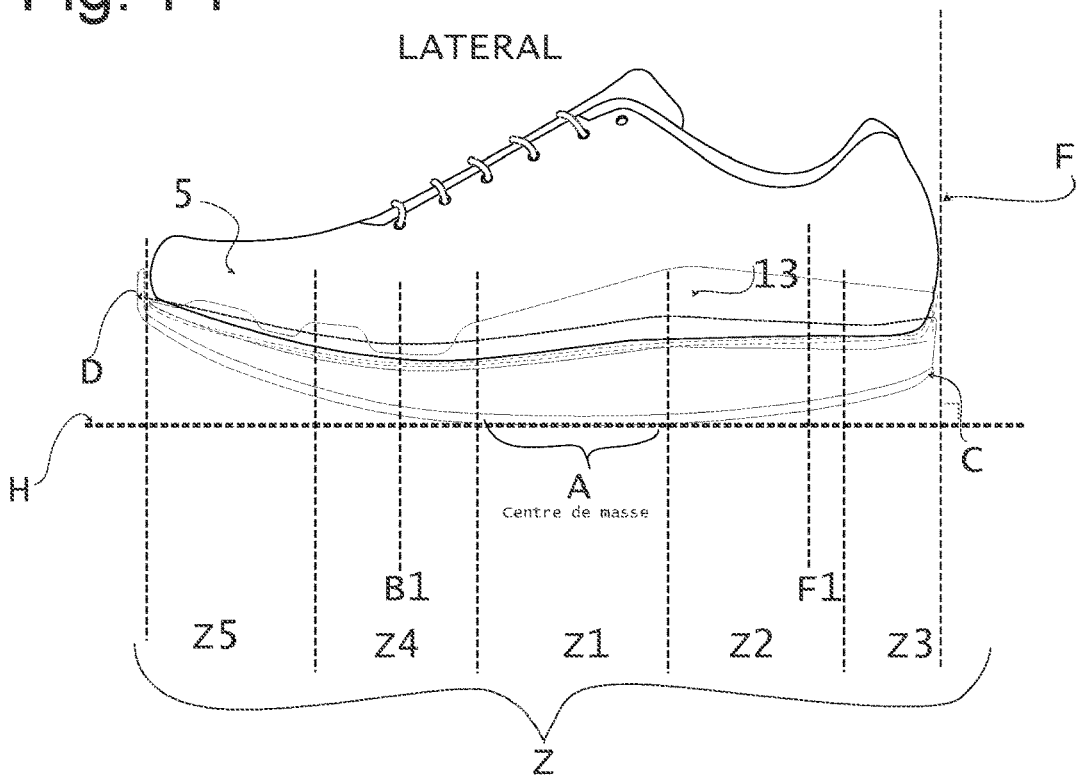

FIG. 14 is a side (medial) view of an aspect of the present disclosure that includes a shell with notches.

Figure 15:
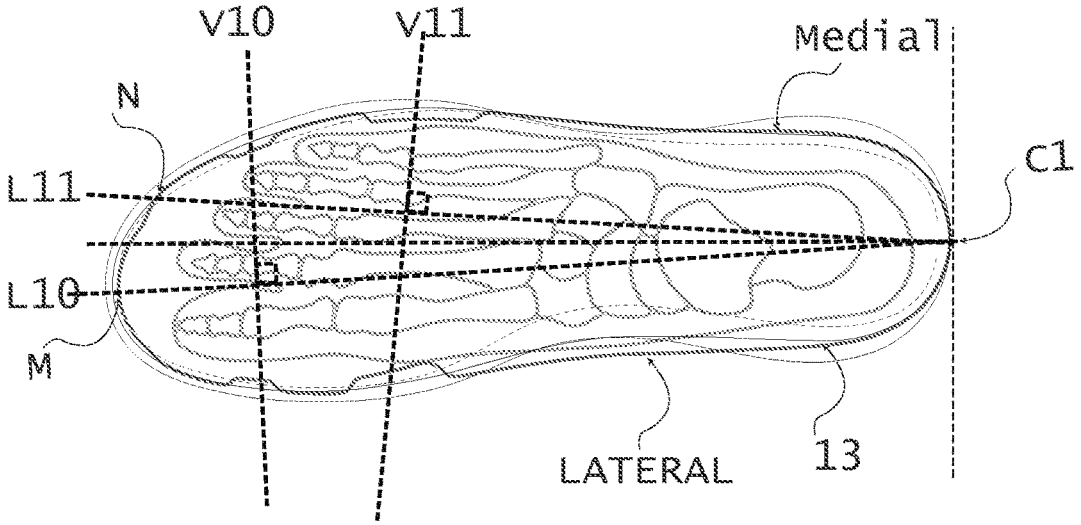

FIG. 15 is a view of the top of the shell with notches.

Figure 16:
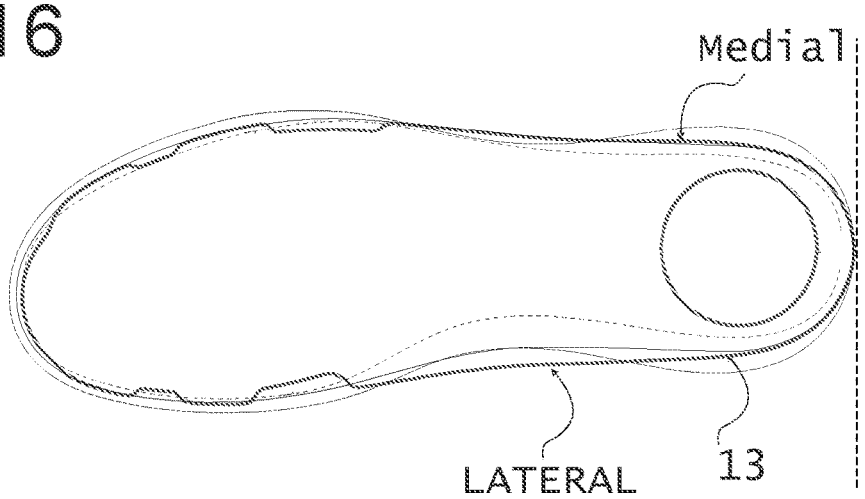

FIG. 16 is a view of the top of the shell with a cavity over the shell bottom.

Figure 17:
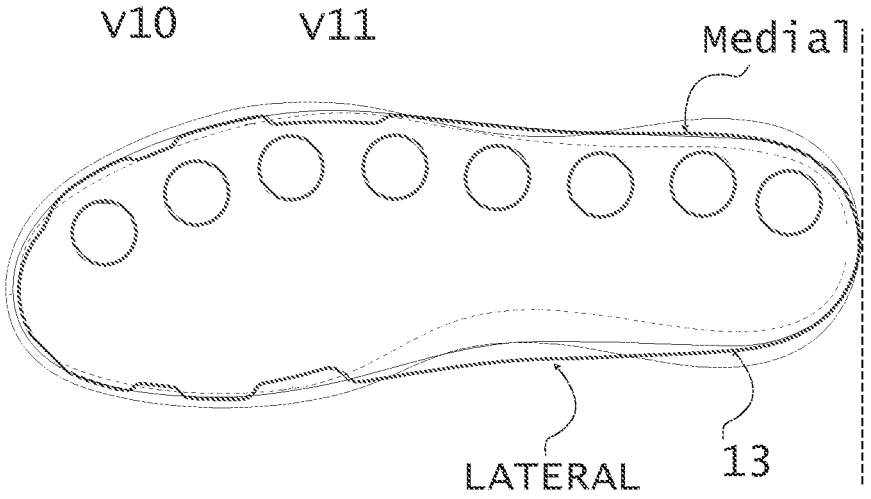

FIG. 17 is a view of the top of the shell with cavities over the shell bottom as claimed in one variant.

Figure 18:
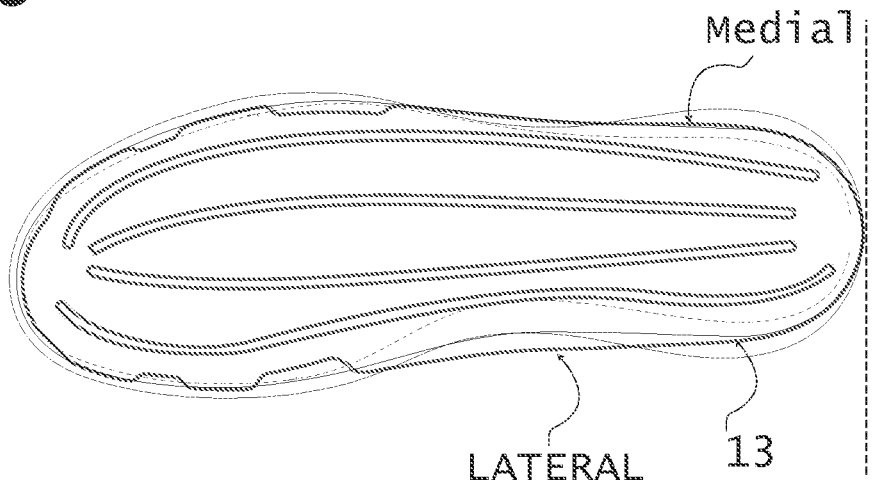

FIG. 18 is a view of the top of the shell with substantially longitudinal cavities over the shell bottom as claimed in another variant.

Figure 4:
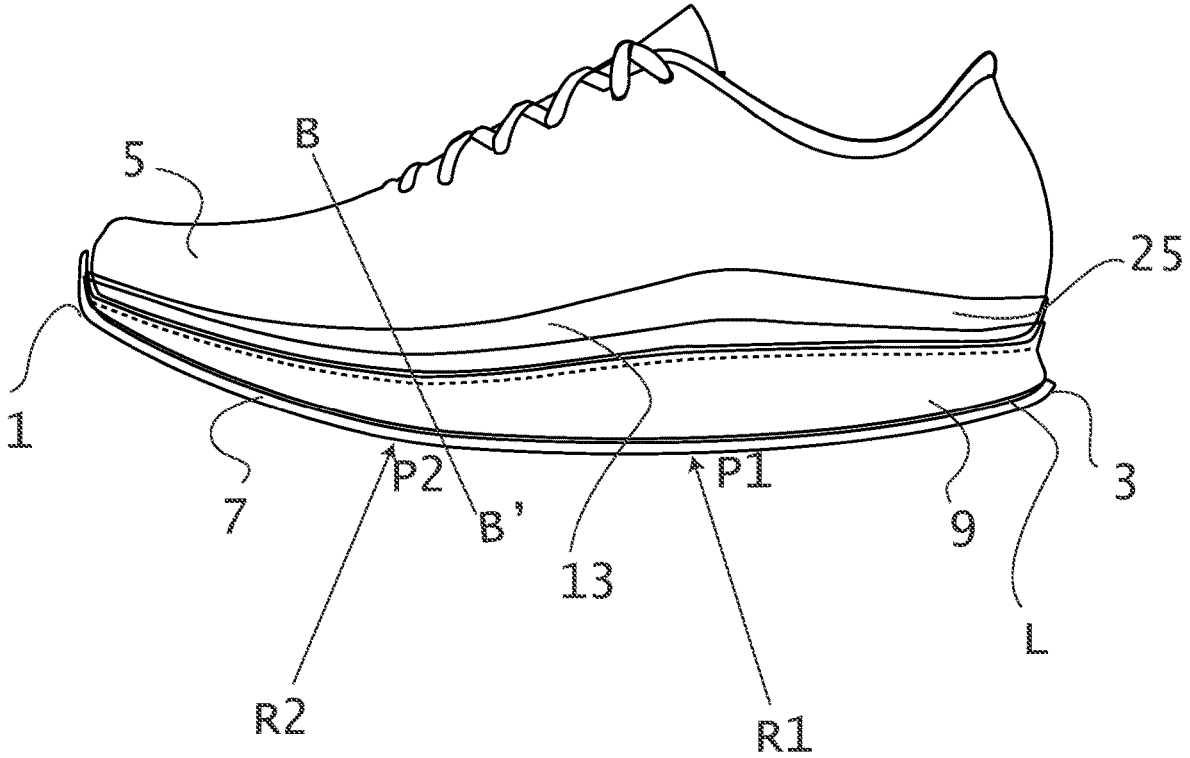
FIG. 4 is a profile view of a second mode of making the present disclosure.
Figure 19:
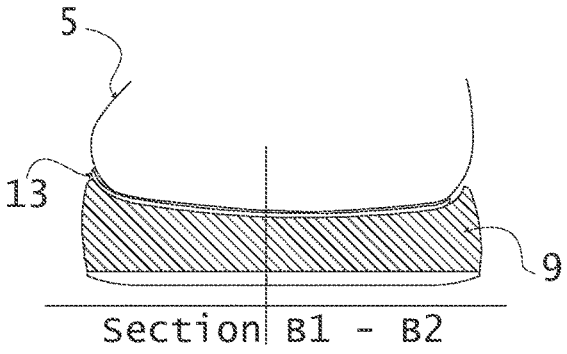
Figure 20:
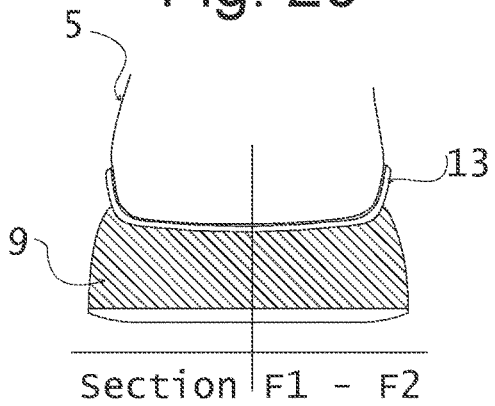

FIGS. 19 and 20 show two cross-sections of an aspect along section lines F1 and B1 of FIG. 4.

DETAILED DESCRIPTION

In reference to FIG. 1, an outsole 7 may be made of an adherent material such as rubber and is designed to provide good ground grip and abrasion resistance. A comfort sole 9 may act as a shock absorber and absorbs shocks when the shoe comes into contact with the ground, particularly through the heel 3. It also has controlled stiffness characteristics by torsion and bending. An upper 5 may be used to keep the foot tight in the shoe and may be equipped with a fastening system 11 by laces or quick-release fasteners. The outsole 7 and the comfort sole 9 may be in mutual engagement, for example by gluing, from toe 1 to heel 3. The outsole 7 may be equipped with a toe cap 71 at the tip 1 of the shoe.

According to the present disclosure, the sports shoe may comprise a shell 13 made of plastic or composite material, interposed between the upper 5 and the comfort sole 9 and with which it is engaged by the heel 3. In correspondence with the heel 3 of the shoe, a rear part 51 of the upper 5 is for example glued to a rear part 17 of the shell 13 and similarly, said rear part 17 is glued to a rear part 91 of the comfort sole 9. The mutual gluing connection can be replaced by a welding connection.

In the design illustrated in FIGS. 1 to 3, shell 13 extends from the rear part 17, corresponding to heel 3, to a front part 19, corresponding to tip 1. However, shell 13 may only extend over one distance less than the distance between heel 3 and toe 1. Reference 21 shows a dotted line at one end of the front part 19 of shell 13, at a distance from the rear part 17, less than the distance between heel 3 and toe 1 of the shoe. In this case, the upper 5 is in direct contact with the comfort sole 9 in the part of the tip 1 of the shoe where the shell 13 is not interposed.

The shell 13 is interposed between the upper 5 and the comfort sole 9 and in taken with these two elements by the heel 3 to, as indicated above, give torsional and bending rigidity to the upper.

In the event of an impact between the heel 3 of the shoe and the ground, the shell 13 prevents the foot from deflecting, tightening in the upper 5 and thus contributing to the stability of the support. On the other hand, the shell is made of plastic or material composite to allow a fraction of the energy released by the shock to be released during relaxation, reducing the fraction of energy dissipated by the comfort sole 9.

Shell 13 is in engagement with upper 5 and comfort sole 9 via a bottom shell 23 and a side shell 25.

In this first mode of construction, the shell side surrounds the bottom of the shell 23 along the rear part 17 of the shell 13 corresponding to heel 1.

As previously mentioned, the interruption of the shell flank 25 gives the toe 1 of the shoe a flexibility while maintaining a stiffness at the heel 3.

This arrangement is more particularly suitable for a race on all roads.

Figure 6:
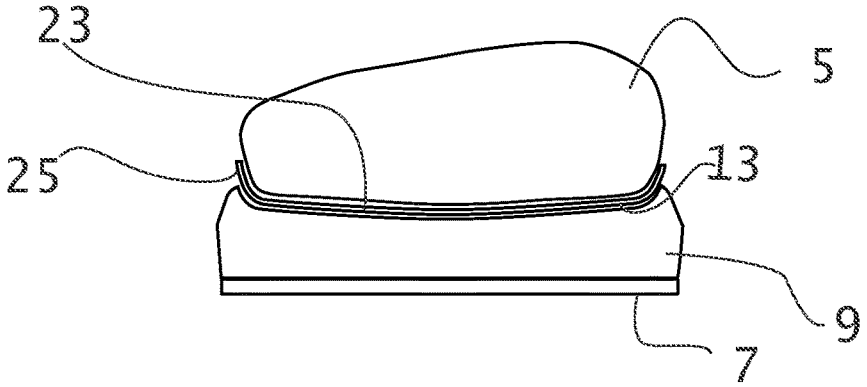
FIG. 6 is a view following the cross section B-B' of FIG. 4.
Figure 5:
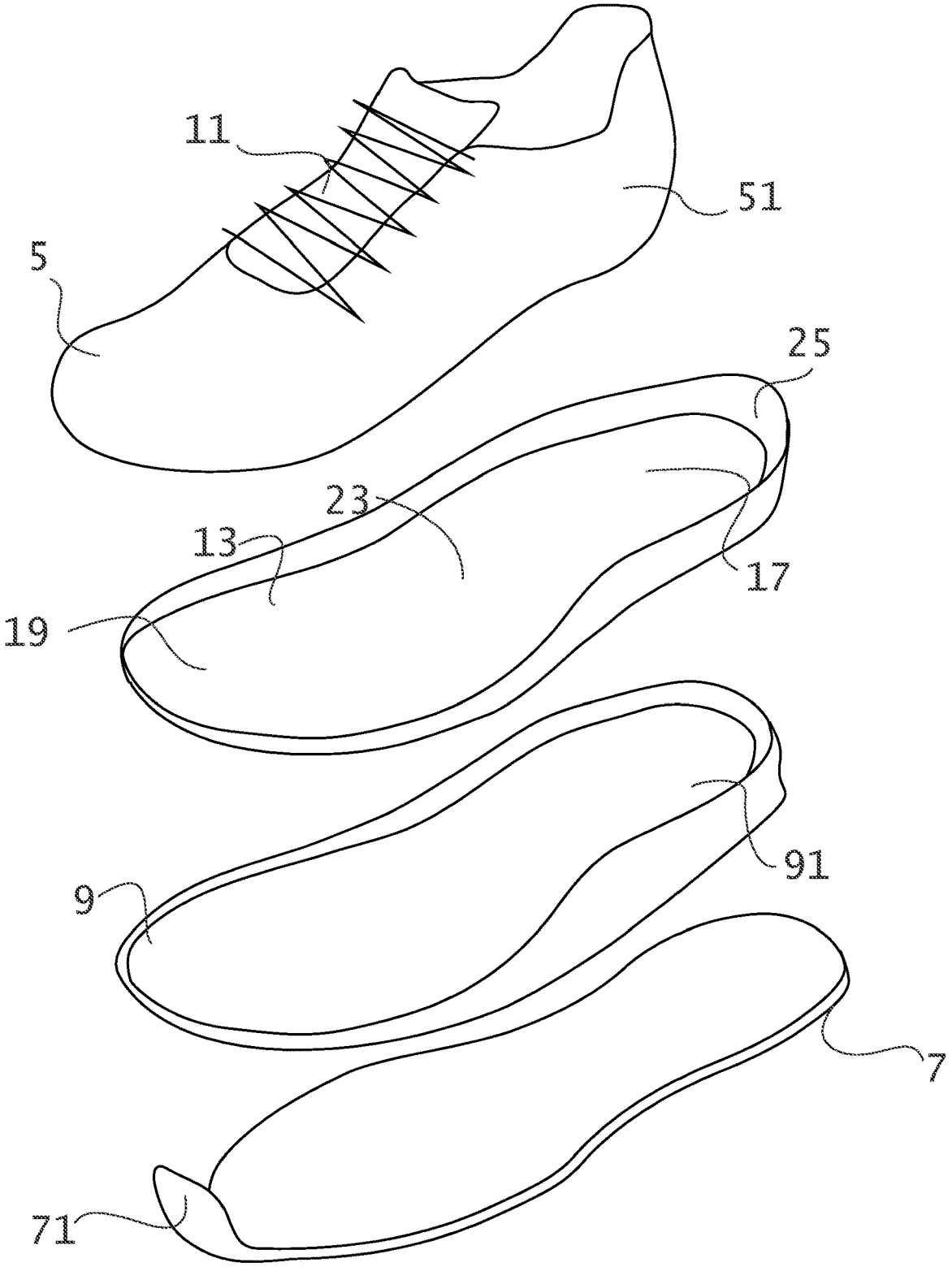
FIG. 5 is an exploded view of FIG. 4.

A second mode of execution, illustrated in FIGS. 4 to 6, is distinguished from the previous mode by the fact that the shell side 25 forms a perimeter around the bottom of the shell 23.

As previously mentioned, the shell side 25 forms a perimeter around the bottom of the shell 23 to allow the shell 13 to stabilize the foot against the ground for a full stride. The foot tightened by the upper 5 is thus maintained in alignment with the alignment taken by the shoe at the moment of the impact of the heel 3 with the ground. On the other hand, the perimeter of the shell side 25 increases the bending and bending stiffness of the shell torsion 13. This arrangement is particularly suitable for a road race.

Figure 7:
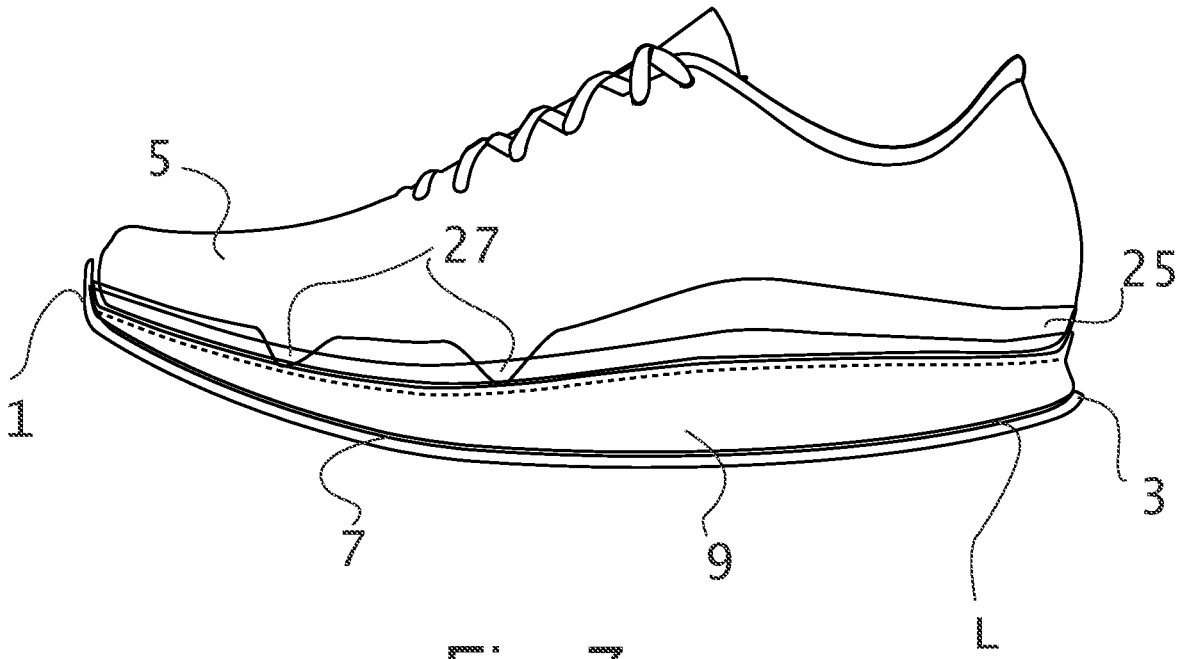
FIG. 7 is a profile view of a first variant of the second mode of making the present disclosure.
Figure 8:
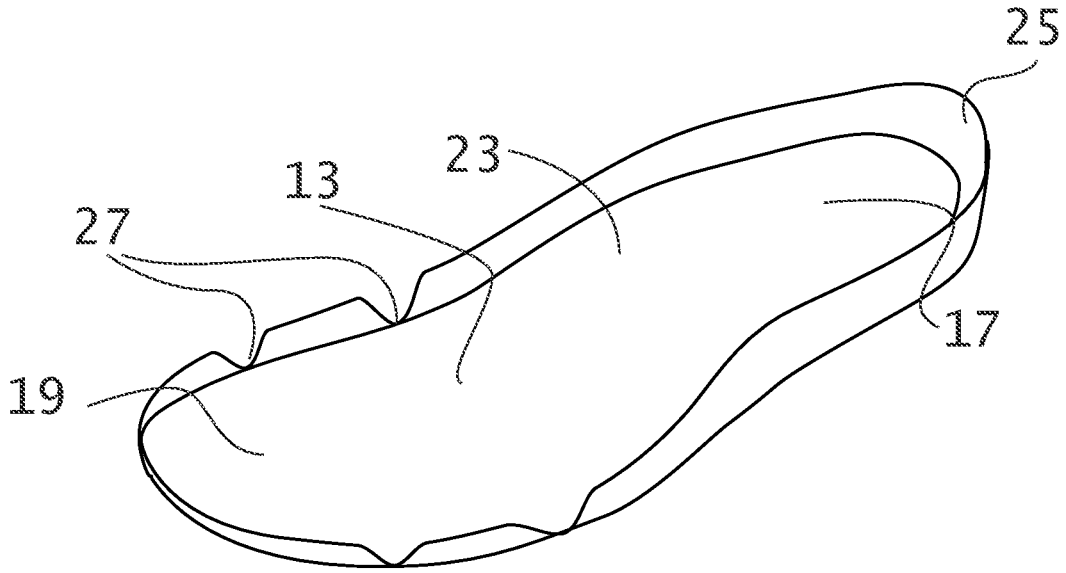
FIG. 8 is a view of the shell of the first design variant illustrated in FIG. 7.

According to a first variant of the second mode of implementation, FIGS. 7 and 8, the shell side 25 is provided with indentations 27.

As indicated above, this arrangement makes it possible to vary the rigidity of shell 13, by delimiting sections of the rigid shell side 25, with the flexibility provided by the indentations between them 27. The indentations 27 are arranged along the perimeter of the bottom of the shell 13, in the front part 19 of the shell 13. They correspond, for example, to the position of the joints between the metatarsus and the phalanges and between the phalanges and the toes of the foot. This design variant is particularly suitable for the stroke in the mountains, called "trail".

Figure 9:
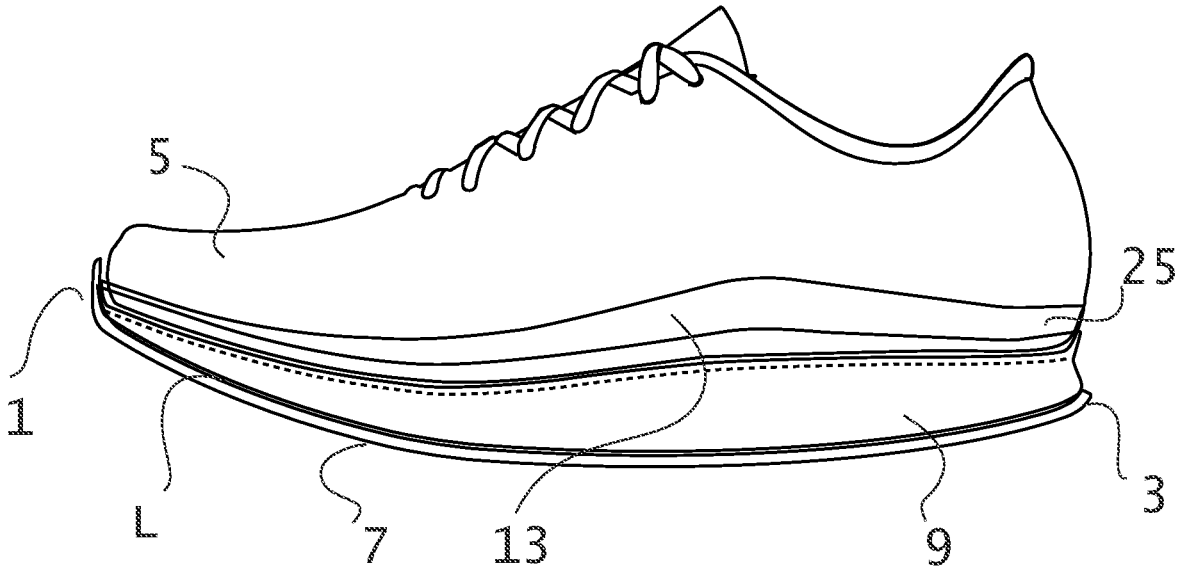
FIG. 9 is a profile view of a second variant of the second mode of making the present disclosure.
Figure 10:
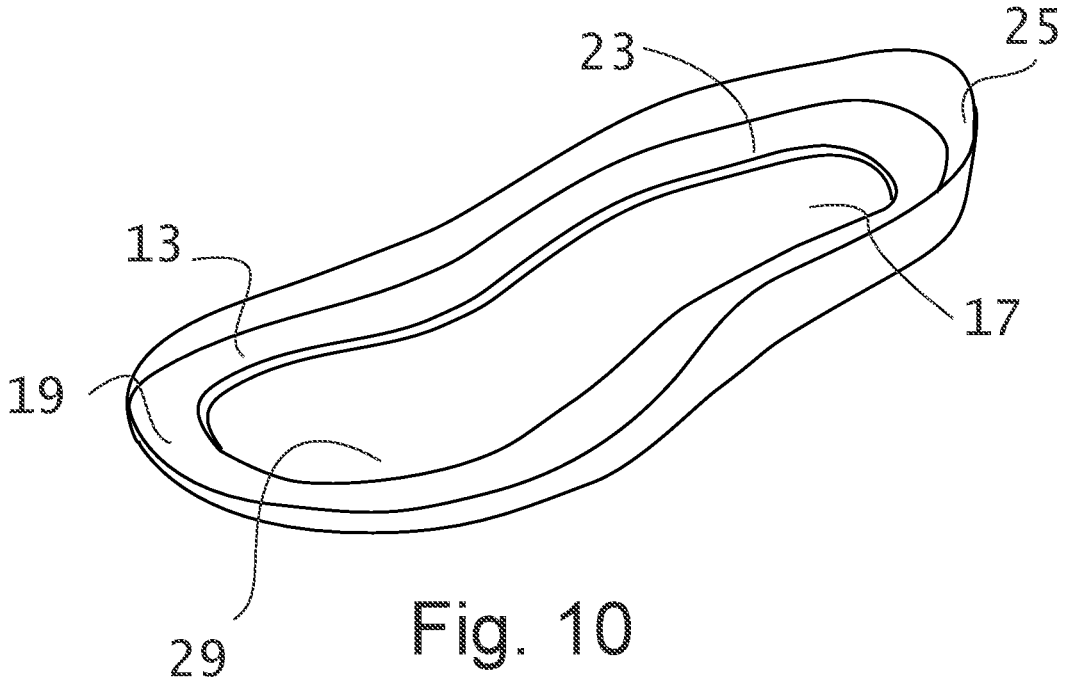
FIG. 10 is a view of the shell of the second design variant shown in FIG. 9.

According to a second variant of the second mode of implementation, FIGS. 9 and 10, the bottom of the shell 23 is openworked. A light 29 reduces the weight of the shell 13 while maintaining the rigidity provided by the shell side 25.

In the first or second mode of execution, the comfort sole 9 has a radius of curvature R at any point P of a line L from heel 3 to toe 1. In FIGS. 1 and 4, points P1 and P2 of line L have radii of curvature R1 and R2.

As previously indicated, the curvature of the comfort sole 9 eliminates the effect of redundancy of the initial impact, felt with a sole of comfort without curvature. The transition from the impact to the unfolding of the foot is instantaneous. Combined with the rigidity of the composite shell 13, the curvature of the comfort sole 9 promotes energy restitution and thus allows faster and therefore more powerful strides The shell is preferably made of a filled polymer resin with glass or carbon fibers. It can also be manufactured by injection of a thermoplastic or thermosetting material. The torsional and bending stiffness will be adjusted, for a given material, according to its thickness and geometry, in particular the height of the shell flank. The comfort layer is preferably made of EVA, but it can also be made of a viscoelastic material or polyurethane foam.

The construction of shoes according to the present disclosure is based on a concept according to which each element of the sole fulfils a distinct function, including the modulation makes it possible to respond to different sports practices, whether it is road racing, road racing or mountain racing. It contributes to the support and guidance of the foot and combines cushioning and a relaunch of the stride.

FIGS. 11 and 12 show an aspect of the shoe as claimed in the present disclosure. The shoe is conventionally constituted of upper (5), which will receive the user's foot, and of an outsole placed below the upper. The external soling is executed according to a stratified profile made of several layers fulfilling distinct functions. It is conventionally constituted of outsole (7) and comfort sole (9).

The underside of the comfort sole, which is in contact with the outsole, has a substantially convex curvature. The side of the comfort sole has a radius of curvature at all points of a line from the heel to the toe and creates an interface with the outsole. The lowest point of the comfort sole, called the center of mass or natural balance point of the shoe, when placed on an appreciably horizontal reference plane, is the transition zone of the roll of the foot having the highest sole radius. The center of mass is scalable and located behind the point of the metatarsals.

In order to promote the roll of the foot, an example of a sole is shown in FIGS. 11 and 12. The sole is divided into several zones (Z). Thus, 5 zones (Z1 to Z5) are represented in FIGS. 11 and 12. Zone (Z1) is the one which corresponds to the center of mass. Zone (Z2) is a transition zone towards the heel whose radius is smaller than the radius of zone (Z1). Zone (Z3) is an impact zone at the heel whose radius is smaller than the radius of Zone (Z2). Zone (Z4) is the area of unrolling towards the toe of the foot, whose radius is smaller than the radius of Zone (Z1). Zone (Z5) is the final unrolling zone whose radius is greater than the radius of Zone (Z4).

In the static phase, in order to find stability on a flat part, a radius of Zone (Z1) that is sufficiently open will be chosen. Thus, the part of Zone (Z1) of comfort layer (9) will be crushed by the weight of the user. It is advantageous for the radius of Zone (Z1) to be between 350 mm and 3000 mm. Of course, this range of values of the radius of Zone (Z1) is only indicative, and those skilled in the craft will know how to choose other values of the radius if necessary.

The transition phase between the impact and the roll of the foot is immediate and without energy loss thanks to the center of mass and the more pronounced dip of Zone (Z4), which is located under the metatarsals. This makes it possible to increase and facilitate the roll of the foot and to obtain a greater range of motion and an optimized push-off phase. Strides become faster and more powerful.

It is, of course, obvious that the absolute and relative values of the radii listed above are only indicative. Indeed, the fields of application and/or physical activities envisaged, as well as the different morphologies of the potential users, such as type and size of foot, weight, type of stride, etc., may also have an influence on the choice of the radii of Zones (Z1 to Z5). Thus, those skilled in the craft may envision a number of zones less than or greater than 5.

The shoe may, however, include at least 3 zones. The two zones on either side of Zone (Z1) corresponding to the center of mass then have radii smaller than that of the center of mass.

When the shoe comprises more than 5 zones, the radii of each zone other than (Z1) may have a radius equal to or different from an adjacent or non-adjacent zone. It is, of course, essential that side of the comfort sole have a radius of curvature at all points of a line from the heel to the toe and creates an interface with the outsole, and that Zone (Z1) corresponding to the center of mass has a radius greater than the two adjacent zones.

Similarly, in order to promote the roll of the foot and to minimize the transition phase between the first impact and center of mass (A), point (C) corresponding to the heel of the outsole and/or comfort sole (9) is set back or at the same level as the part of the upper furthest from the center of mass. This principle, which has the effect of advancing the contact point to Zone (A) as much as possible, favors the dynamic phase of the walk, on flat ground as well as on inclines.

This configuration allows outsole (7) to advance the first contact zone towards the center of mass as far as possible during the natural roll of the foot and to remain in contact during the first phase of impact on the ground; this happens during the entire phase of the roll of the foot regardless of where the foot is placed, without generating a second impact.

As indicated in FIGS. 12 to 14, the shoe may comprise shell (13) that is sufficiently rigid, which prevents the arch from being pushed up the foot in the static and dynamic phases. Shell (13) is positioned above the comfort sole and is glued firmly over the entire surface thereof. The shell represents a constraint device for this comfort sole and this center of mass.

Comfort sole (9) is made of a material that ensures comfort and keeps the foot in place. It is made of a damping material such as rubber or EVA. The comfort sole may also be PU (polyurethane), or any other natural or synthetic foam. PU is harder, and therefore offers less immediate comfort than EVA. However, it is more durable and will have more flexibility over time. The rubber is very soft and very flexible, but it is heavier. The cushioning material of the comfort layer may also be a material having elastic or viscoelastic properties, such as elastomer.

In FIGS. 11 to 14, in order to move the first impact phase as close as possible to center of mass (A) and to favor the strike zone and the natural roll of the foot, the comfort sole is placed in front of line (F). Line (F) is a line perpendicular to substantially horizontal plane (H) on which the shoe is placed. Line (F) passes through point (J), which is in the zone of the heel farthest from center of mass (A).

As mentioned above, the lower part of comfort sole (9), which is contiguous with outsole (7), has a radius of curvature at any point on a line from the heel to the toe, and creates continuity on both sides with center of mass (A). This configuration allows outsole (7) to always remain in contact in the first phase of impact with the ground and during the entire phase of the roll of the foot, regardless of where the foot is placed, without generating a second impact, thanks to the mechanical connection that stabilizes the lines of force of shell (13) and comfort sole (9).

Outsole (7) is made of any synthetic or natural material offering the properties necessary for outsoles, such as adhesion and wear resistance. The nature of the material used for the outsole is not limited to the usual materials in the field of shoes. It will be chosen according to the envisaged use of the shoe, the nature of the ground, the adhesion and the desired wear resistance, etc.

As shown in FIGS. 12 to 14, the shoe may comprise sufficiently rigid shell (13) placed between upper (5) and comfort sole (9). Shell (13) is positioned above comfort sole (9) and is glued firmly over the entire surface thereof. Shell (13), which represents a constraint device for this comfort sole and this center of mass, makes it possible in the static and dynamic phase to prevent the arch of the foot from being pushed towards the top of the foot. Shell (13) thus promotes the stability of the center of mass and the roll of the foot by a gradual crushing without deformation of the arch.

Molded shell (13), which has the shape of the shoe's last, decreases impact and energy loss during the support phase. It positions the body correctly, without any effort, in order to execute strides optimally.

Shell (13) also helps to promote the crush of the center of mass without deforming the arch. In addition, this shell imparts torsional and flexural rigidity to the upper that counteracts foot displacement during impacts between the heel of the shoe and the ground and thus contributes to the stability of the support and increases the comfort sole's flexural rigidity.

Shell (13) may comprise, consist essentially of, or consist of a shell bottom and a shell side rising towards upper (5). The rise of the shell side makes it possible to obtain an additional stability effect through compression of the upper, which may be added to the stability effect linked to the gluing of shell (13) to the comfort sole.

In another aspect, as shown in FIG. 12, the shell side forms an edge around said shell bottom for greater rigidity of the flexion zone.

The shell may be also asymmetrical to help hold the foot. In the lateral zone, the shell side is higher and longer towards the toe in order to favor the stabilization of the arch.

As shown in FIGS. 15 to 18, in order to fully hold the foot while allowing the roll of the foot, notches are notably placed opposite each other on substantially transverse lines (V10, V11). Substantially transverse line (V10) may be perpendicular to substantially longitudinal line (L10) passing through heel (C1) and point (M) located at the level of the toe. Substantially transverse line (V11) may be perpendicular to substantially longitudinal line (L11) passing through the heel, and a point (N) located at the front of the shell and outside point (M) towards the medial edge.

The number of notches is, of course, variable. They are not necessarily an even number and in perfect opposition.

The shell sides are also glued to the surfaces in contact with the outsole. Shell (13) also imparts torsional and flexural stiffness to the upper, longitudinally and laterally.

The preferred manufacturing materials for the shell are loaded or non-loaded polyurethane (PUR, TPU), loaded or non-loaded polyamide (PA), polyethylene (PE), and generally all loaded or non-loaded synthetic materials.

Composite materials, for example, based on fiberglass/carbon fiber and synthetic resin, are also options.

We can also consider the use of metallic materials and, for example, aluminum alloys, or natural materials such as bamboo or other wood fiber.

For each shell, the thickness will be a function of the desired degree of elasticity and the Young's modulus of the chosen material.

Depending on the desired applications, the shell and the comfort sole may have similar or different stiffnesses. In the latter case, a shell (13) can be chosen that is more rigid than comfort sole (9), or vice versa.

According to FIGS. 19 and 20, the shell and the shell sides are in contact with the heel at the top of the section in FIG. 19 and FIG. 20 (F1 F2). Section B1 B2 according to FIG. 19 shows that the notches on the front part of the foot do not have a shell side.

In another aspect, shell (13) may be recessed in different areas of the shell bottom, FIGS. 16 to 18. These openings promote the crushing of comfort sole (9) in the support phases or on uneven surfaces; they also limit the weight of the shell.

Thus, FIG. 16 shows an opening which may be placed at the heel.

FIG. 17 shows several openings that are placed along the medial edge.

The openings according to FIGS. 16 and 17 may be circular or not. Those skilled in the craft will be able to choose the appropriate shape of the openings according to the desired characteristics of the shell and/or production requirements.

In FIG. 18, several longitudinal openings are shown which extend approximately between the heel and the toe. The number of longitudinal openings is, of course, not limited to the four seen in the figure. They may be distributed symmetrically or asymmetrically and have varying lengths. They may be rectilinear or curvilinear. The longitudinal openings may also be disconnected. In this case, the different longitudinal sections of the openings may be aligned or not.

Although the present disclosure has been described in particular with respect to preferred aspects, it is obvious to those skilled in the craft that these aspects as described in the figures and in the description are not limiting in nature. It is clear to those skilled in the craft that variations other than those described and shown may be contemplated without departing from the scope of the present disclosure as defined in the claims.

Aspects A:

A1. Sports shoe extending between a toe (1) and a heel (3) and comprising an upper (5) in engagement with a wear sole (7) via a comfort sole (9), characterized in that it comprises a shell (13) made of plastic or composite material, 5 interposed between the upper (5) and the comfort sole (9) and with which it is engaged by the heel (3).

Aspects B:

B1. Sports shoe extending between a toe (1) and a heel (3) and comprising a shaft (5), in engagement with a wear sole (7) by via a comfort sole (9) and a shell (13), made of plastic or composite material, interposed between the upper (5) and the sole (9) and with which it is in grip by the heel (3) up to the tip (1) through a bottom shell (23) and a side shell B2. A sports shoe according to aspect B1, in which the shell (13) made of plastic or composite material is interposed and in engagement with the upper (5) and the comfort sole (9) up to the 10 point (1).

B3. A sports shoe according to aspect B2, in which the shell (13) made of plastic or composite material is interposed and in engagement with the upper (5) and the comfort sole (9) by via a bottom shell (23) and a side shell (25).

Aspects C:

C1. Sports shoe extending between a toe (1) and a heel (3) and comprising a shaft (5), in engagement with a wear sole (7) by via a comfort sole (9) and a shell (13), made of plastic or composite material, interposed between the upper (5) and the sole (9) and with which it is in grip by the heel (3) up to the tip (1) through a bottom shell (23) and a side shell C2. A sports shoe according to aspect C1, in which the shell (13) made of plastic or composite material is interposed and in engagement with the upper (5) and the comfort sole (9) up to the 10 point (1).

C3. A sports shoe according to aspect C1, in which the sole of the shoe comfort (9) has a radius of curvature (R1, R2) at any point (P1, P2) a line (L) from the heel (3) to the toe (1) and interfacing with the wear sole (7).

C4. the sports shoe according to aspect C3, in which the flank-shell (25) surrounds the bottom of the shell (23) in a part (17) of the shell (13) corresponding to the heel (3) and is interrupted along said bottom shell (25) in a part (19) corresponding to the tip (1).

C5. A sports shoe according to aspect C3, wherein the flank 20 a shell (25) forms a periphery of said bottom shell (23).

C6. A sports shoe according to aspect C5, in which the flank-shell (25) is provided with indentations (27).

C7. A sports shoe according to aspect C3, in which the bottom of the shell (23) is openworked.

C8. A sports shoe according to aspect C1, in which the comfort sole (9) has a radius of curvature (R1, R2) in total point (P1, P2) of a line (L) running from the heel (3) to the toe (1) and making interface with the wear sole (7).

C9. A shoe, especially for high-performance sports, intended to provide an advantage in the practice of physical activities such as running, speed walking, or normal walking, extending between toe (D) and heel (C) and comprising upper (5) and comfort sole (9) attached to outsole (7); the comfort sole has a radius of curvature at any point of a line from heel (C) to toe (D) and interfaces with outsole (7), wherein the lowest point of comfort sole (9) and outsole (7), called the center of mass or balance point of the sole or natural balance point of the shoe, when placed on substantially horizontal reference plane (H) is transition zone (Z1) of the roll of the foot having the highest radius of the comfort sole and the outsole, and in that the center of mass is behind point (B) of the metatarsals.

C10. The shoe of aspect C9, wherein the radius of curvature at any point of the line from heel (C) to toe (D) of the comfort sole and the outsole is divided into several zones (Z) having different radii of curvature.

C11. The shoe of aspect C10, wherein the radius of curvature at any point of the line from heel (C) to toe (D) of the comfort sole and the outsole advantageously comprises 5 Zones (Z1) to (Z5) having different radii of curvature.

C12. The shoe of aspect C11, wherein Zones (Z1 to Z5) are Zone (Z1) which corresponds to the center of mass which has the highest radius of the comfort sole, Zone (Z2) which is a transition zone towards the heel whose radius is smaller than the radius of Zone (Z1), Zone (Z3) which is an impact zone at the heel whose radius is smaller than the radius of Zone (Z2), Zone (Z4) which is a roll zone running toward the tip of the foot with a radius smaller than the radius of Zone (Z1), and Zone (Z5) which is a final roll zone whose radius is greater than the radius of Zone (Z4).

C13. The shoe of any one of aspects C9 to C12, wherein it comprises shell (13) which also participates in promoting the crushing of the center of mass placed between upper (5) and comfort sole (9).

C14. The shoe of aspect C13, wherein the shell comprises a shell side which forms an edge around the shell bottom.

C15. The shoe of aspect C14, wherein the side shell has notches.

C16. The shoe of aspect C15, wherein the notches are placed substantially in opposition on substantially transverse lines (V10, V11).

C17. The shoe of aspect C16, wherein substantially transverse line (V10) is perpendicular to substantially longitudinal line (L10) passing through heel (C1) and point (M) located at the level of the toe, and in that substantially transverse line (V11) is perpendicular to substantially longitudinal line (L11) passing through the heel and point (N) located at the front of the shell and on the exterior side of point (M).

C18. The shoe of aspect C14, wherein one or more openings are placed on the shell bottom.

C19. The shoe of aspect C18, wherein an opening is placed on the shell bottom at the heel.

C20. The shoe of aspect C18, wherein several openings are placed on the shell bottom along the outer contour of the foot.

C21. The shoe of aspect C18, wherein one or more substantially longitudinal openings are located on the shell bottom between the heel and the toe.

What is claimed is:

1. A shoe comprising:

an upper;

a comfort sole attached to an outsole, the comfort sole having a radius of curvature at any point of a line from a heel to a toe and interfacing with outsole;

a center of mass zone, wherein the center of mass zone comprises a center of mass of the shoe and further comprises the lowest point of comfort sole and outsole, and, when the shoe is placed on a substantially horizontal reference plane, the center of mass zone corresponds to a balance point of the roll of a foot, the center of mass zone having the highest radius of curvature of the comfort sole and the outsole, and wherein center of mass zone is located behind a point of the comfort sole and outsole that corresponds to a location of the metatarsals of the foot when the shoe is worn;

a transition zone disposed between the center of mass zone and a heel portion of the shoe, the transition zone having a radius of curvature less than the radius of curvature of the center of mass zone;

and a rigid shell interposed between the upper and the comfort sole and configured to provide torsional and bending rigidity to the upper, wherein the rigidity of the composite shell and the curvature of the comfort sole promote energy restitution and thus allows faster or more powerful strides for a wearer.

2. The shoe of claim 1, wherein the shell is formed from an energy releasing composite material configured to allow energy to be released during relaxation from an impact event, thereby reducing the fraction of energy dissipated by the comfort sole.

3. The shoe of claim 2, wherein, during the impact event, the shell is configured to stabilize and limit deflection of the foot, and the upper is configured to compress, such that the foot tightens in the upper, thus contributing to stability of the wearer.

4. The shoe of claim 1, wherein the shell comprises a shell side which forms an edge around at least a portion of the shell bottom.

5. The shoe of claim 4, wherein the shell side comprises a plurality of notches formed therein.

6. The shoe of claim 5, wherein the notches are disposed substantially in opposition on substantially transverse lines.

7. The shoe of claim 6, wherein the notches are disposed in opposition on each of a first substantially transverse line of the substantially transverse lines that is perpendicular to a substantially longitudinal line passing through the heel and a point located at the level of the toe, and a second substantially transverse line of the substantially transverse lines that is perpendicular to a substantially longitudinal line passing through the heel and a point located at the front of the shell and on the exterior side of point.

8. The shoe of claim 4, wherein one or more openings are disposed through the shell bottom.

9. The shoe of claim 8, wherein the one or more openings comprise an opening disposed through on the shell bottom at or adjacent the heel.

10. The shoe of claim 8, wherein at least a portion of the one or more openings are placed on the shell bottom along a region corresponding to an outer contour of the foot.

11. The shoe of claim 8, wherein the one or more openings comprise one or more substantially longitudinal openings disposed on the shell bottom between the heel and the toe.

12. The shoe of claim 1, wherein the shell comprises a filled polymer resin.

13. The shoe of claim 1, wherein the shell comprises carbon fiber.

14. The shoe of claim 1, wherein the comfort sole comprises a dampening material.

15. A method of making the shoe of claim 1.

16. A shoe comprising:

an outsole, an upper coupled to the outsole;

a comfort sole coupled to an outsole, the comfort sole having a radius of curvature at any point of a line from a heel to a toe;

a center of mass zone, wherein the center of mass zone comprises a center of mass of the shoe and further comprises the lowest point of comfort sole and outsole and, when placed on a substantially horizontal reference plane, the center of mass zone corresponds to a balance point of the roll of a foot, the center of mass zone having the highest radius of curvature of the comfort sole and the outsole, and wherein the center of mass zone is located behind a point of the comfort sole and outsole that corresponds to a location of the metatarsals of a foot when referenced from toe to heel;

a transition zone disposed between the center of mass zone and a heel portion of the shoe, the transition zone having a radius of curvature less than the radius of curvature of the center of mass zone; and a rigid shell interposed between the upper and the comfort sole and configured to provide one or more of torsional rigidity or bending rigidity to the upper, wherein the rigidity of the composite shell and the curvature of the comfort sole promote energy restitution and thus allows faster or more powerful strides for a wearer, wherein the shell comprises a shell side which forms an edge around at least a portion of the shell bottom, and wherein the shell side comprises a plurality of notches formed therein.

17. The shoe of claim 16, wherein the shell comprises a filled polymer resin.

18. The shoe of claim 16, wherein the shell comprises carbon fiber.

19. The shoe of claim 16, wherein the comfort sole comprises a dampening material.

20. A method of making the shoe of claim 16.

* * * * *